US006676072B1

(12) United States Patent
Kim et al.

(10) Patent No.: US 6,676,072 B1
(45) Date of Patent: Jan. 13, 2004

(54) SHORT DURATION, HIGH-TORQUE ROCKET NOZZLE

(76) Inventors: Steven S. Kim, 2803 Billhimer Ct., Crofton, MD (US) 21114; Eric Hawley, 523 N. Imboden St. Apt. 204, Alexandria, VA (US) 22304

( * ) Notice: Subject to any disclaimer, the term of this patent is extended or adjusted under 35 U.S.C. 154(b) by 0 days.

(21) Appl. No.: 10/292,948

(22) Filed: Nov. 13, 2002

(51) Int. Cl.[7] ..... F42B 10/00
(52) U.S. Cl. ..... 244/3.23; 244/3.22
(58) Field of Search ..... 244/3.23, 3.21; 160/222, 224; 239/265.19, 165.37

(56) References Cited

U.S. PATENT DOCUMENTS

| | | | | |
|---|---|---|---|---|
| 2,500,537 A | * | 3/1950 | Goddard | |
| 2,611,317 A | * | 9/1952 | Africano | |
| 3,260,205 A | | 7/1966 | Dietrich | 102/51 |
| 3,414,217 A | * | 12/1968 | Kesting | |
| 3,790,103 A | | 2/1974 | Peoples | 244/3.23 |
| 3,952,970 A | | 4/1976 | Orzechowski et al. | 244/3.23 |
| 4,194,706 A | | 3/1980 | Detalle | 244/3.23 |
| 4,497,460 A | | 2/1985 | Thorsted et al. | 244/3.23 |
| 4,936,218 A | * | 6/1990 | Wosenitz | |
| 4,995,318 A | * | 2/1991 | Stidston et al. | |
| 5,020,436 A | | 6/1991 | Coburn | 102/377 |
| 5,082,202 A | | 1/1992 | Jacobson | 244/322 |
| 5,511,745 A | | 4/1996 | Faupell et al. | 244/3.22 |
| 6,548,794 B2 | * | 4/2003 | Facciano et al. | |

FOREIGN PATENT DOCUMENTS

| | | | | |
|---|---|---|---|---|
| BE | 520064 | * | 5/1955 | 244/3.23 |

* cited by examiner

*Primary Examiner*—Tien Dinh
(74) *Attorney, Agent, or Firm*—Mark Homer

(57) ABSTRACT

A rocket spin control system for a tube launched rocket has a fixed position nozzle on the rocket and a set of internally positioned torque ring inside of the nozzle that is anchored with erodible tabs. The tabs erode as the rocket exits the launcher. With the erosion of the tabs, the torque ring is free to rotationally move, which eliminates any torque imparted onto the rocket while retaining the torque ring with the rocket. This increases the reliability of rocket precision.

18 Claims, 1 Drawing Sheet

SHORT DURATION, HIGH-TORQUE ROCKET NOZZLE

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to rocket torques vanes fitted within rocket nozzles. More particularly, the rocket nozzles of the present invention possess a torque ring with low erodible torque vanes that are fitted between two sections of the rocket. The torque ring is rotationally anchored with erodible retainers that erode during launch of the rocket from the rocket launcher. Most particularly, the torque ring remains attached to the rocket nozzle after the torque ring has imparted torque to the rocket, while providing an appropriate torque to the rocket during the time period of immediately prior to and just after rocket exit from the rocket launcher.

2. Brief Description of the Related Art

The 2.75-Inch rocket nozzle of the MK 66 MOD 4 Rocket Motor currently in use by the United States Navy contains flutes machined into the nozzle body of the rocket. These flutes provide a maximum torque of 3 ft.-lbs., resulting in a rocket spin rate at launcher exit of 8 Hz. Problematic with the 2.75-Inch rocket nozzle is the fact that the 3 ft.-lbs. of torque does not shut-off during the motor burn. A fin assembly on the 2.75-Inch Rocket provides an anti-spin component to the rocket to prevent the rocket motor from suffering a catastrophic reaction as it spins into its bending mode frequency. An alternative method using erodible vane configuration suffers from a tendency of the vanes eroding at the aft edge of any slot holding mechanism.

There is a need to provide increased torque to rockets, particularly the 2.75-Inch rocket, while allowing the elimination of the torque during rocket launch. The present invention addresses this and other needs.

SUMMARY OF THE INVENTION

The present invention includes a rocket spin control system for a tube launched rocket comprising a torque vane system having a plurality of substantially low erodible vanes, the torque vane system attachable to the rocket, wherein the plurality of low erodible vanes are positionally fixed aft of the rocket propelling thrust effective to impart rapid spin to the rocket and one or more erodible retainers attachable to the torque vane system, wherein the erodible retainer retains the torque vane system in a manner that secures the substantially low erodible vanes in a fixed angular orientation within the rocket propelling thrust effective to provide torque to the rocket until the one or more erodible retainers erode wherein the torque vane system remains attached to the rocket and ceases to provide torque to the rocket.

The present invention also includes a method for imparting a spin on a rocket comprising the steps of providing a rocket spin control system for a tube launched rocket comprising a torque vane system having a plurality of substantially low erodible vanes, the torque vane system attachable to the rocket, wherein the plurality of low erodible vanes are positionally fixed aft of the rocket propelling thrust effective to impart rapid spin to the rocket and one or more erodible retainers attachable to the torque vane system, wherein the one or more erodible retainers retain the torque vane system in a manner that secures the low erodible vanes in a fixed angular orientation within the rocket propelling thrust effective to provide torque to the rocket until the one or more erodible retainers erode wherein the torque vane system remains attached to the rocket and ceases to provide torque to the rocket and launching the rocket from the launch tube, wherein the one or more erodible retainers erode.

The present invention further includes a rapid spin rocket product produced by the method comprising the steps of providing a rocket spin control system for a tube launched rocket comprising a torque vane system having a plurality of substantially low erodible vanes, the torque vane system attachable to the rocket, wherein the plurality of low erodible vanes are positionally fixed aft of the rocket propelling thrust effective to impart rapid spin to the rocket and one or more erodible retainers attachable to the torque vane system, wherein the one or more erodible retainers retain the torque vane system in a manner that secures the substantially low erodible vanes in a fixed angular orientation within the rocket propelling thrust effective to provide torque to the rocket until the one or more erodible retainers erode wherein the torque vane system remains attached to the rocket and ceases to provide torque to the rocket and launching the rocket from the launch tube, wherein the one or more erodible retainers erode.

The present invention provides greater torque for greater rocket spin rate to improve rocket impact precision. The invention also incorporate a mechanism to prevent a rocket spin at its bending mode frequency. Increasing the rocket spin rate at rocket launch improves rocket precision by averaging out the rocket thrust misalignment that causes imprecision.

The present invention is particularly useful on a tube launched rocket, such as a 2.75 inch rocket.

DETAILED DESCRIPTION OF THE PREFERRED EMBODIMENT

The present invention provides a high torque nozzle for a rocket system having low erodible vanes, particularly the 2.75-Inch rocket. The low erodible high torque vanes are internally positioned inside of the rocket nozzle to impart torque to the rocket during rocket launch from a rocket launcher. The present invention includes a system of low erodible vanes fixed in position with an erodible retainer, with the low erodible torque vane system preferably comprising a torque ring having a plurality of the low erodible vanes. The erodible retainer erodes after a set time which allows the low erodible torque vanes to freely spin relative to the nozzle thrust. With this free movement, no additional torque is imparted onto the rocket. This improves the precision of the rocket by removing the effect of the vanes, i.e., removing the torque imparted to the rocket after the rocket has left the rocket launcher. Additionally, imprecision occurs from thrust misalignment that is due to the tolerance stack-ups at the nozzle and motor joint. The nozzle of the present invention increases the rocket spin rate at launcher exit from 8 to 40 Hz. By increasing the rocket spin rate, the thrust misalignment averages out, minimizing its precision error contribution. This high rocket motor spin rate at launch is significant for improving the rocket precision.

Figure 1:
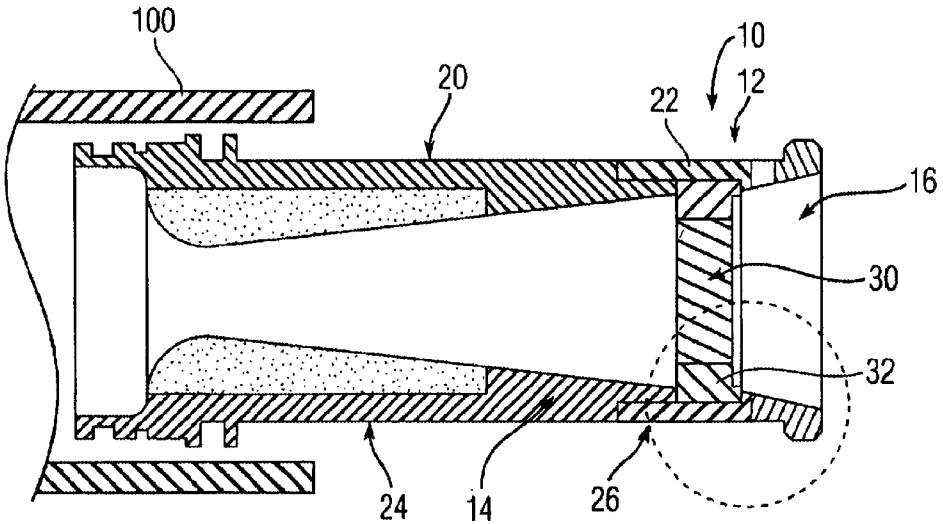
FIG. 1 shows a side cut away view of a rocket nozzle section of the present invention having two threaded sections with a torque ring rotationally held in place with erodible retainers; and, FIG. 2 is a cross-sectional rear view of the present invention, shown in FIG. 1, showing the torque ring abutting a Teflon® insert held with a erodible retainer.
Figure 2:
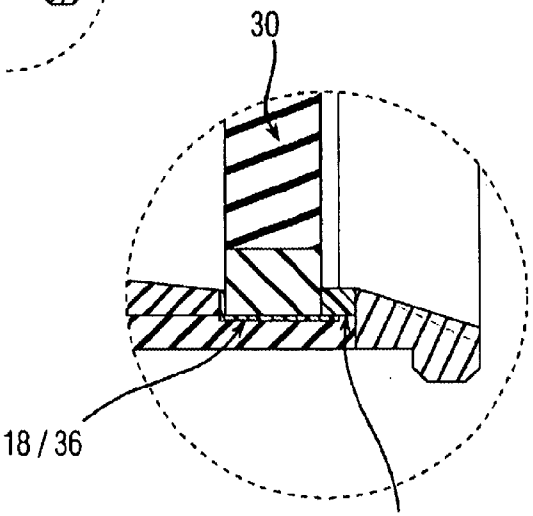

As seen in FIGS. 1 and 2, the rocket spin control system 10 for a tube launched rocket 12 of the present invention includes a rocket 12 having a fixed position nozzle 20. Inside of the fixed position nozzle 20, and aft of the propelling thrust of the rocket 12, are a set of internally positioned substantially low erodible high torque vanes 30, constituting part of a torque vane system 26, that are fixed within the nozzle 20 by one or more erodible retainers 28. During launch, the high torque vanes 30 impart rapid spin to the rocket 12 from rocket ignition to exit of the rocket 12 from a launch tube 100. Prior to, concurrent with, or just after the rocket 12 exiting the launch tube 100, the erodible retainers 28 are eroded which frees the torque vane system 26 to freely move relative to the rocket 12. As such the torque vane system 26 remains within the propelling thrust of the rocket 12 but does not impart any torque onto the rocket 12 once freed. The rocket spin control system 10 may further include a spin neutral fin assembly that is located on the outside of the nozzle 20 for rocket 12 guidance.

By remaining attached to the rocket 12, the torque vane system 26 does not create a hazard during launch of the rocket 12 from the launch tube 100. Additionally, the torque vane system 26 does not depend on being ejected from the rocket 12, which reduces the failure rate of a torque imparting system.

Referring to FIGS. 1 and 2, the rocket spin control system 10 has two sections, a first section of a rocket nozzle body 14 and a second section 16 of a rocket nozzle body 24. These two body sections 14 and 16 interconnect to hold the torque vanes system 26 in place along the length of the rocket 12. The torque vane system 26 includes a plurality of low erodible torque vanes 30 that are attached to a low erodible ring mechanism in the form of a torque ring 32, which is fitted between the first 14 and second 16 sections of the rocket nozzle body 24 within a groove 18 formed by the connecting first 14 and second 16 sections of the rocket nozzle body 24.

When the first 14 and second 16 sections of the rocket nozzle body 24 are connected, the two sections 14 and 16 form a groove 18 suitable for inserting and retaining the torque ring 32 within the fixed position rocket nozzle 20. The groove 18 includes an open area between the first 14 and second 16 rocket body sections that allows the torque ring 32 to fit in the groove 18, while allowing the torque ring 32 to rotationally move therein. The two sections 14 and 16 are connected by any suitable mechanism for holding 22 the two sections 14 and 16 together, such as latching, hooking, screwing, adhering and the like, with the appropriate holding mechanism being determinable by one of ordinary skill in the art in light of the disclosure herein. Preferably, the high torque nozzle system 10 is preferably configured for the first 14 and second 16 sections of the rocket nozzle 20 connect by a threaded mating connection that permits the two sections 14 and 16 to be screwed together. Most preferably the threaded mating connection is right-handed, and as such the imparted spin of the launching rocket 12 further rotationally forces the first 14 and second 16 rocket body sections together at the threaded connection where two sections 14 and 16 are mated together. Alternatively, the two sections 14 and 16 may be formed as a single piece.

As seen in FIG. 2, the groove 18 may include a frictionally reduced surface 36 along the area where the torque ring 32 abuts the rocket nozzle 20. FIG. 2 shows the torque ring 32 abutting frictionally reduced surface 36 made of a Teflon® insert while being held in place with the erodible retainers 28. The groove 18 preferably contains this frictionally reduced surface 36 along the surface to which the torque ring 32 connects to the rocket 12. This frictionally reduced surface 36 aids the free movement of the torque ring 32 once freed from the restraint of the erodible retainer(s) 28. The frictionally reduced surface 36 may include any appropriate surface suitable for the high temperature and turbulent environment of the rocket thrust, such as a Teflon® coating or insert and other like surface materials, or the use of high temperature lubricants and the like. The use of coatings, inserts and/or lubricants may additionally prevent galvanic corrosion with the use of metallic torque rings 32.

The torque ring 32 preferably has one or more slots 36 therein. These slots 36 provide attachment to and restraint by the erodible release tabs 28.

The rocket spin control system 10 further includes one or more erodible retainers 28 which are attached to the rocket nozzle body 24 and the inserted torque ring 32. The erodible retainers 28 rotationally fix the torque ring 32 retained within the groove 18 of the rocket nozzle body 24. The erodible retainers 28 are composed of any suitable composition for erosion from rocket thrust heat and high imparted rocket torque within the appropriate time period during launch of the rocket 12. The selection of the composition is determinable by those skilled in the art for a material that effectively erodes during the expected 0.07 seconds of operation of the low erodible torque vanes 30. The composition may include, for example, plastic, thermoplastic, silica-phenolic, glass-phenolic, refractory metal, carbon-carbon, carbon-phenolic, graphite-phenolic and ceramic. Preferably the one or more erodible retainers 28 comprise a thermoplastic composition or phenolic composition. Suitable compositions include, for example, 20 percent by weight of glass in combination with 80 percent by weight of thermoplastic, such as that sold under the tradename Lexan by General Electric, or other like compositions such as nylon 6/6 manufactured by Amco Plastic Materials. The configuration of the erodible retainers 28 may include any appropriate design or shape for its given retention purpose, as determinable by one skilled in the art in light of the disclosure herein. Preferred configurations include, for example, tab, strip, patch and other suitable configuration for anchoring the torque ring 32. Most preferably, the erodible retainers 28 are configured in a tab configuration. Suitable thicknesses, widths, depths and masses of the erodible retainer(s) 28 may be determinable by ordinary experimentation with, for example, thicknesses of from about 1 millimeter to about 5 millimeters, widths of from about 2 millimeters to about 6 millimeters, depths of from about 2 millimeters to about 4 millimeters, and masses of from about 0.04 grams to about 0.14 grams being particularly applicable for rotationally anchoring the torque ring 32 with the groove 18.

The erodible retainer(s) 28 retain the torque vane system 26 in a manner that secures the low erodible torque vanes in a fixed angular orientation within the rocket propelling thrust. The low erodible torque vanes 30 stop imparting torque onto the rocket, i.e., the torque vane system 26 freely moves relative to the rocket thrust, once the one or more erodible retainer(s) 28 have eroded from the propelling thrust of the rocket 12. During launch, the low erodible vanes 30 are not needed to slow the rocket 12 spin because the torque shut-offs at launcher tube 100 exit with the erosion of the erodible retain(s) 28 and the free movement of the torque vane system 26 sufficient to remove the influence of the low erodible torque vanes 30. With the torque ring 32 placed within the groove 18, the low erodible torque vanes 30 extend through the nozzle 20 body into the thrust of the rocket 12. The placement of the torque ring 32 into the groove 18 prevents the torque ring 32 from being ejected from the rocket nozzle 20. Any appropriate number of low erodible torque vanes 30 may be used, preferably from about 12 or less, and more preferably from about 8 to about 10 low erodible torque vanes 30 are used. The low erodible vanes 30 are attached to and incorporated into the torque ring 32 in any appropriate arrangement, preferably in equal distances along the surface of the torque ring 32. The individually torque vanes 30 are attached to the torque ring 32 in a manner that allows the torque ring 32 to be placed within the formed groove 18 between the first 14 and second 16 rocket body sections while allowing both rotational movement thereto and the torque vanes 30 to be within the rocket thrust during launch to provide torque. Suitable compositions of the low erodible torque vanes 30 may be determined by one skilled in the art, with preferred compositions including, for example, metallic and phenolic materials. Preferably, each of the low erodible vanes 30 are identical to the other low erodible vanes 30 on the torque ring 32. The torque ring 32 of the rocket spin control system 10 may include a ring structure 34 connected to the plurality of low erodible vanes 30 separately connected, as a single molded piece, or in combinations thereof. In the form of a single molded piece, the torque ring 32 is preferably formed from the same composition as the torque vanes 30.

For the 2.75 inch rocket, the dimensions of the low erodible torque vanes 30 are preferably from about 0.5 inches to about 0.7 inches in length, from about 0.06 to about 0.12 inches in width, and from about 0.2 to about 0.3 inches in depth (D). Preferably, the erodible vane 30 extend from about 0.2 inches to about 0.3 inches into the rocket nozzle 20. The circumference of the torque ring 32 preferably ranges from about 1.9 inches to about 2.1 inches.

Once within the groove 18, the torque ring 32 is rotationally anchored with the one or more erodible retainers 28. The erodible retainers 28 are located within the thrust of the rocket 12 to allow complete failure, i.e., removal of the erodible retainers 28 as rotational anchors to the torque ring 32, which allows the torque ring 32 to spin within the groove 18 while the low erodible torque vanes 30 are exposed to the thrust of the rocket 12. With the free rotational movement, i.e., spinning or circular rotation, of the torque ring 32, the torque ring system 26 ceases to impart torque onto the rocket 12 even as the rocket thrust continues to impact the low erodible torque vanes 30.

The rocket spin control system 10 imparts a spin on the rocket 12 during rocket launch. By fixing the torque ring 32 between the first section 14 and second section 16 of the rocket nozzle 20 of the high torque nozzle system 10, the torque ring 32 retains a higher reliability for remaining fixed in place during launch. The formed groove 18 houses the torque ring 32 in a manner that prohibits inappropriate torque ring 32 ejection from the launching rocket 20, which may occur in systems that do not have such a securing mechanism.

In operation, the secured torque ring 32, with the plurality of low erodible torque vanes 30, between the first 14 and second 16 sections of the rocket nozzle body 24, remains longitudinally fixed from retention by the groove 18 and rotationally fixed from one or more erodible retainer(s) 28 within the nozzle 20 as the rocket 12 is launched from the rocket launcher 100. As the rocket 12 exits the launcher 100, the erodible retainer(s) 28, being exposed to the thrust of the rocket 12, erode. This erosion of the erodible retainer(s) 28 during rocket 12 exit occurs immediately prior to, concurrently with, or just after rocket launch from the launcher 100. As such, the rocket 12 may still be contained within the launcher 100 or within about 10 feet from the launcher 100 for the erodible retainer(s) 28 to have eroded. The erodible retainer(s) 28 erode in a manner to impart proper torque onto the launching rocket 12. For a 2.75 inch rocket, and other similar weapons, the erodible retainer(s) 28 erode in from about 0.05 seconds to about 0.10 seconds after rocket launch (i.e., rocket ignition), such as for example 0.07 seconds. The torque ring 32 imparts from about 10 ft-lb or greater pounds of torque to the launched rocket, preferably from about 10 ft-lb to about 15 ft-lb of torque to the launched rocket 12 for an approximate time of 0.07 seconds, which equates to expected rocket 12 exit from the launcher 100. The low erodible torque vanes 30, in combination with the nozzle 20, preferably spin the rocket to 40 Hz, which minimizes the effects of thrust misalignment. As the rocket 12 exits the launch tube 14, the rocket 12 possesses low forward velocity and minimal gyroscopic stability. Perturbation, such as thrust misalignments and side winds, have a significant influence on the rocket's flight direction. As the erodible retainer(s) 28 erode, and "shut-off" the torque at launcher 100 exit, the rocket spin rate does not exceed its first bending mode frequency, such as from about 50 to about 60 Hz, which would have a catastrophic effect on the rocket 12.

Launch of the rocket 12 having the high torque nozzle system 10 of the present invention results in a rapid spin rocket. The rapid spin produced onto rocket 12 eliminates launch imprecision that occurs from thrust misalignment of the rocket nozzle 20 and motor joint. The rapid spin minimizes the precision error contribution by averaging out the thrust misalignment. The present invention achieves higher torque capability and better torque vane attachment than previously known. The launched rapid spin rocket generally has a greatly improved Circular Error Probable, preferably ranging from about 5 milliradians or less.

The rocket spin control system 10 is particularly useful on rocket 12, such as a military surface or air-launched weapon. Most preferably the rocket spin control system 10 is useful on the 2.75 inch rocket currently used by the United States Navy and Marine Corps.

EXAMPLE 1

A precision analysis from a ground launch perspective was completed that predicted that the 2.75-Inch Rocket with a torque ring anchored by erodible retainer(s) attached between to nozzle body sections improved the rocket precision error from about 19-milliradians to about 5-milliradians.

EXAMPLE 2 (prophetic)

The precision of the 2.75-Inch Rocket is improved with the incorporation of a torque ring secured in a groove with erodible tabs between two nozzle body sections erodible having eight low erodible vanes equally spaced along the circumference of the torque ring. A lubricant is applied to the groove prior to placement of the torque ring therein. The torque ring is overlaid with erodible tabs sufficiently to rotationally anchor the torque ring. During launch the of the 2.75-Inch Rocket spin at launcher exit increases to about 40 hertz. At approximately 0.7 seconds from firing of the rocket, nozzle torque is shut-off at launcher exit. This occurs with the erodible tabs eroding and freeing the torque ring to rotate along the inner surface of the groove while the rocket is in motion.

The 2.75-Inch Rocket Motor with the torque ring fixed with erodible tabs is fired at a target with no effect on ballistic performance. The increased spin rate averages out thrust misalignment. The retractable vanes increase the rocket accuracy by approximately 360%.

EXAMPLE 3 (prophetic)

The precision of the 2.75-Inch Rocket is improved with the incorporation of a torque ring secured in a groove between two nozzle body sections erodible having ten low erodible vanes equally spaced along the circumference of the torque ring. The torque ring is anchored with erodible strips applied to the inner surface of the nozzle after the placement of the torque ring therein. During launch the of the 2.75-Inch Rocket spin at launcher exit increases to about 40 hertz. At approximately 0.7 seconds from firing of the rocket, nozzle torque is shut-off at launcher exit. This occurs with the erosion of the erodible strips which frees the torque ring to rotationally turn within the groove.

The 2.75-Inch Rocket Motor with the torque ring anchored by erodible strips is fired at a target with no effect on ballistic performance. The increased spin rate averages out thrust misalignment. The retractable vanes increase the rocket accuracy by approximately 360%.

EXAMPLE 4 (comparative)

The rocket spin rate of the 2.75-Inch Rocket was increased to over 20 Hz with a molded plastic ring with erodible torque vanes. The molded plastic ring was glued into the end of the nozzle body. The plastic ring ejected from the 2.75-Inch Rocket about 50 percent of the time, causing hazardous debris.

The foregoing summary, description, examples and drawings of the invention are not intended to be limiting, but are only exemplary of the inventive features which are defined in the claims.

What is claimed is:

1. A rocket spin control system for a tube launched rocket, comprising:

a torque vane system having a plurality of substantially low erodible vanes, the torque vane system attachable to the rocket, wherein the plurality of low erodible vanes are positionally fixed aft of the rocket propelling thrust effective to impart rapid spin to the rocket; and, one or more erodible retainers attachable to the torque vane system, wherein the erodible retainer retains the torque vane system in a manner that secures the substantially low erodible vanes in a fixed angular orientation within the rocket propelling thrust effective to provide torque to the rocket until the one or more erodible retainers erode wherein the torque vane system remains attached to the rocket and ceases to provide torque to the rocket.

2. The rocket spin control system of claim 1, wherein the torque vane system freely moves relative to the rocket thrust once the one or more erodible retainers erode.

3. The rocket spin control system of claim 2, wherein the torque vane system comprises a low erodible ring mechanism.

4. The rocket spin control system of claim 3, wherein the low erodible ring mechanism comprises one or more slots therein.

5. The rocket spin control system of claim 3, wherein the low erodible ring mechanism freely moves in a circular rotation.

6. The rocket spin control system of claim 1, wherein the torque vane system attaches to the rocket along a frictionally reduced surface.

7. The rocket spin control system of claim 1, wherein the torque vane system attaches to the rocket between two rocket body halves forming a groove therebetween.

8. The rocket spin control system of claim 1, wherein the plurality of low erodible vanes are internally positioned inside of the nozzle of the rocket.

9. The rocket spin control system of claim 8, wherein the nozzle of the rocket comprises a fixed position nozzle.

10. The rocket spin control system of claim 1, wherein the plurality of substantially low erodible vanes comprises a composition selected from the group consisting of metallic and phenolic materials.

11. The rocket spin control system of claim 1, wherein the one or more erodible retainers comprise a tab configuration.

12. The rocket spin control system of claim 1, wherein the one or more erodible retainers comprise a composition selected from the group consisting of plastic, thermoplastic, silica-phenolic, glass-phenolic, refractory metal, carbon-carbon, carbon-phenolic, graphite-phenolic and ceramic.

13. The rocket of claim 1, wherein the rocket comprises a 2.75 inch rocket.

14. A method for imparting a spin on a rocket, comprising the steps of:

providing a rocket spin control system for a tube launched rocket comprising a torque vane system having a plurality of substantially low erodible vanes, the torque vane system attachable to the rocket, wherein the plurality of low erodible vanes are positionally fixed aft of the rocket propelling thrust effective to impart rapid spin to the rocket and one or more erodible retainers attachable to the torque vane system, wherein the one or more erodible retainers retain the torque vane system in a manner that secures the low erodible vanes in a fixed angular orientation within the rocket propelling thrust effective to provide torque to the rocket until the one or more erodible retainers erode wherein the torque vane system remains attached to the rocket and ceases to provide torque to the rocket; and, launching the rocket from the launch tube, wherein the one or more erodible retainers erode.

15. The method of claim 14, wherein the one or more erodible retainers erode prior to the rocket exiting the tube.

16. The rocket spin control system of claim 14, wherein the torque vane system imparts a rocket spin of from about 40 hertz to about 50 hertz onto the rocket.

17. The rocket spin control system of claim 14, wherein the torque vane system generates a torque of from about 10 foot-pounds or more.

18. A rapid spin rocket product produced by the method comprising the steps of:

providing a rocket spin control system for a tube launched rocket comprising a torque vane system having a plurality of substantially low erodible vanes, the torque vane system attachable to the rocket, wherein the plurality of low erodible vanes are positionally fixed aft of the rocket propelling thrust effective to impart rapid spin to the rocket and one or more erodible retainers attachable to the torque vane system, wherein the one or more erodible retainers retain the torque vane system in a manner that secures the substantially low erodible vanes in a fixed angular orientation within the rocket propelling thrust effective to provide torque to the rocket until the one or more erodible retainers erode wherein the torque vane system remains attached to the rocket and ceases to provide torque to the rocket; and, launching the rocket from the launch tube, wherein the one or more erodible retainers erode.

* * * * *